US009139401B2

(12) United States Patent
Finschi et al.

(10) Patent No.: US 9,139,401 B2
(45) Date of Patent: Sep. 22, 2015

(54) ELEVATOR SYSTEM OPERATION CHANGING FROM A FIRST MODE TO A SECOND MODE OF OPERATION

(75) Inventors: Lukas Finschi, Ebikon (CH); Stefan Röllin, Baar (CH)

(73) Assignee: Inventio AG, Hergiswil NW (CH)

( * ) Notice: Subject to any disclaimer, the term of this patent is extended or adjusted under 35 U.S.C. 154(b) by 829 days.

(21) Appl. No.: 13/395,418

(22) PCT Filed: Sep. 11, 2009

(86) PCT No.: PCT/EP2009/061805

§ 371 (c)(1), (2), (4) Date: Jul. 23, 2012

(87) PCT Pub. No.: WO2011/029479

PCT Pub. Date: Mar. 17, 2011

(65) Prior Publication Data

US 2012/0279807 A1 Nov. 8, 2012

(51) Int. Cl.
*B66B 1/20* (2006.01)
*B66B 1/24* (2006.01)

(52) U.S. Cl.
CPC ..... *B66B 1/2458* (2013.01); *B66B 1/2466* (2013.01); *B66B 2201/103* (2013.01); *B66B 2201/104* (2013.01); *B66B 2201/211* (2013.01); *B66B 2201/215* (2013.01); *B66B 2201/216* (2013.01); *B66B 2201/222* (2013.01); *B66B 2201/241* (2013.01); *B66B 2201/303* (2013.01); *B66B 2201/306* (2013.01); *B66B 2201/401* (2013.01); *B66B 2201/403* (2013.01)

(58) Field of Classification Search
CPC ..... B66B 1/2458; B66B 1/2466; B66B 2201/104; B66B 2201/211; B66B 2201/215; B66B 2201/216; B66B 2201/222; B66B 2201/241; B66B 2201/303; B66B 2201/306; B66B 2201/401; B66B 2201/403; B66B 2201/103
USPC ..... 187/247, 380–388, 391–393
See application file for complete search history.

(56) References Cited

U.S. PATENT DOCUMENTS 5,229,559 A * 7/1993 Siikonen et al. ..... 187/391
5,241,142 A * 8/1993 Thangavelu ..... 187/385

(Continued)

FOREIGN PATENT DOCUMENTS

GB 2 267 362 A 12/1993

OTHER PUBLICATIONS

International Search Report dated Jun. 14, 2010 and Notification of Transmittal of International Preliminary Report on Patentability dated Dec. 5, 2011 for PCT/EP2009/061805.

*Primary Examiner* — Anthony Salata
(74) *Attorney, Agent, or Firm* — Stroock & Stroock & Lavan LLP

(57) ABSTRACT

An elevator system includes at least one elevator, at least one call input device and a call controller. The call input device transmits a call to the call controller. For a transmitted normal operation signal, at least one elevator car of an assigned elevator is activated to drive to the call input floor by at least one elevator controller of the assigned elevator. In a peak-time mode of the elevator system, at least one main operation signal is transmitted to at least one elevator. For a main operation signal transmitted to an elevator, at least one elevator car of said elevator is activated to drive between at least two main operation floors by at least one elevator controller of said elevator.

20 Claims, 7 Drawing Sheets

(56) References Cited

U.S. PATENT DOCUMENTS

| | | | | | |
|---|---|---|---|---|---|
| 5,258,586 | A * | 11/1993 | Suzuki et al. | ..... | 187/392 |
| 5,260,526 | A * | 11/1993 | Sirag, Jr. | ..... | 187/387 |
| 5,274,202 | A * | 12/1993 | Kezer et al. | ..... | 187/385 |
| 5,612,519 | A * | 3/1997 | Chenais | ..... | 187/382 |
| 5,786,550 | A * | 7/1998 | Thangavelu | ..... | 187/386 |
| 6,257,373 | B1 * | 7/2001 | Hikita et al. | ..... | 187/392 |
| 6,328,134 | B1 * | 12/2001 | Hikita | ..... | 187/382 |
| 6,364,065 | B1 * | 4/2002 | Hikita | ..... | 187/382 |
| 7,487,860 | B2 * | 2/2009 | Hikita et al. | ..... | 187/249 |
| 8,220,591 | B2 * | 7/2012 | Atalla et al. | ..... | 187/383 |
| 2007/0084674 | A1 * | 4/2007 | Tyni | ..... | 187/382 |

* cited by examiner

| | |
|---|---|
| 1 | ELEVATOR CAR |
| 2 | ELEVATOR CONTROLLER |
| 3 | CALL CONTROLLER |
| 4 | CALL INPUT APPARATUS |
| 5 | SENSOR |
| 10 | ELEVATOR |
| S0 | SHAFT |
| S1 .. S9 | LANDING |

| | |
|---|---|
| 40 | OUTPUT APPARATUS |
| 41 | INPUT APPARATUS |
| 51 | LIGHT SENSOR |
| 52 | CAMERA |
| 53 | ULTRASOUND SENSOR |
| 54 | INFRARED SENSOR |
| 55 | WEIGHING APPARATUS |
| 56 | NOISE-LEVEL SENSOR |
| 57 | TRANSMITTING/RECEIVING APPARATUS |

1 ELEVATOR CAR
5 SENSOR
40 OUTPUT APPARATUS

S2

10 ELEVATOR
51 LIGHT SENSOR
52 CAMERA
53 ULTRASOUND SENSOR

1 ELEVATOR CAR
4 CALL INPUT APPARATUS
5 SENSOR
40 OUTPUT APPARATUS
41 INPUT APPARATUS
42 RADIO FIELD
43 MOBILE COMMUNICATION APP.
54 INFRARED SENSOR

S2

55 WEIGHING APPARATUS
56 NOISE-LEVEL SENSOR
57 TRANSMITTING/RECEIVING APP.

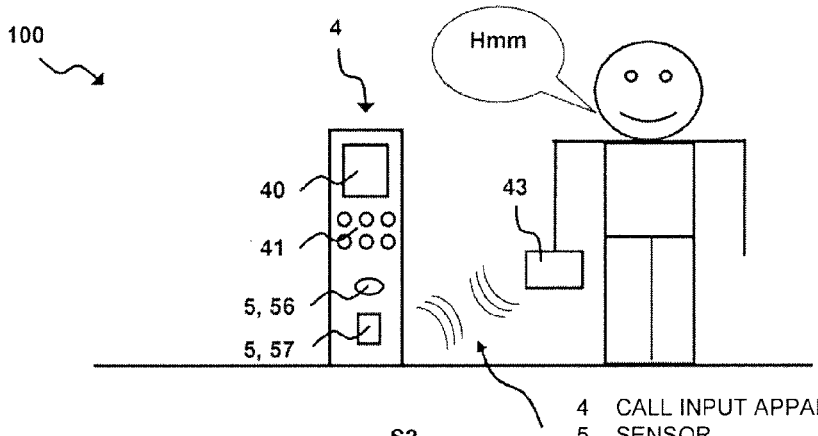

Fig. 5

4 CALL INPUT APPARATUS
5 SENSOR
40 OUTPUT APPARATUS
41 INPUT APPARATUS
42 RADIO FIELD
43 MOBILE COMMUNICATION APP.
54 INFRARED SENSOR
56 NOISE-LEVEL SENSOR
57 TRANSMITTING/RECEIVING APP.

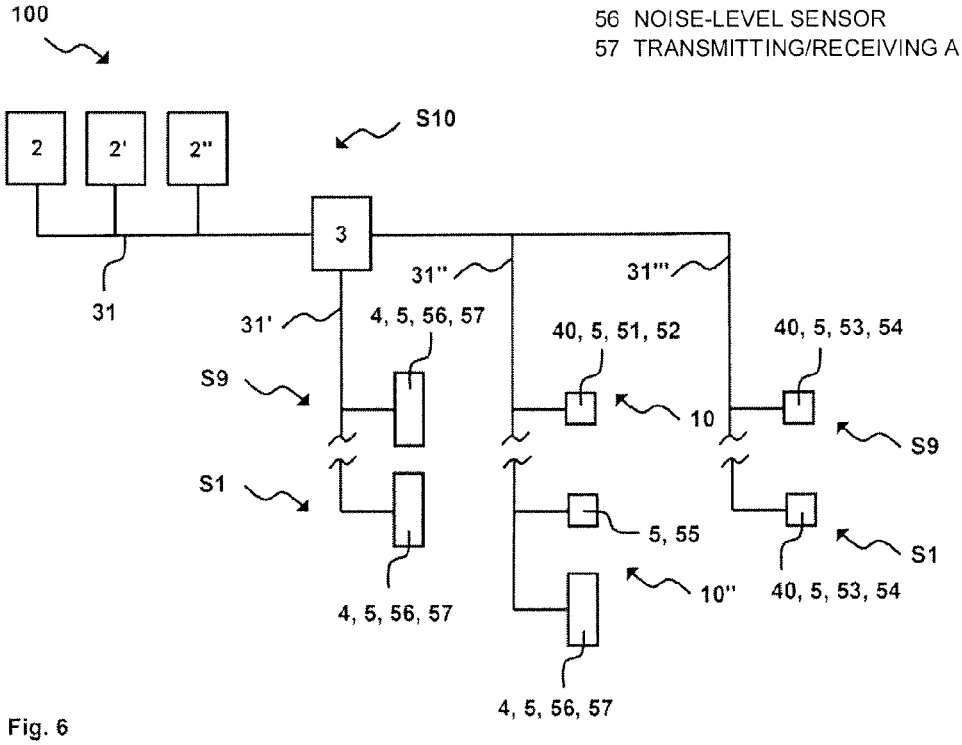

Fig. 6

2 ELEVATOR CONTROLLER
3 CALL CONTROLLER
4 CALL INPUT APPARATUS
5 SENSOR
10 ELEVATOR
31 SIGNAL BUS
40 OUTPUT APPARATUS
41 INPUT APPARATUS
42 RADIO FIELD
51 LIGHT SENSOR
52 CAMERA
53 ULTRASOUND SENSOR
54 INFRARED SENSOR
56 NOISE-LEVEL SENSOR
57 TRANSMITTING/RECEIVING APP.
S1, S9 LANDING,
S10 MACHINE AREA

ELEVATOR SYSTEM OPERATION CHANGING FROM A FIRST MODE TO A SECOND MODE OF OPERATION

FIELD

The disclosure relates to a method for operation of an elevator installation.

BACKGROUND

GB2267362A1 discloses an elevator installation having a plurality of elevators and a group controller. Each elevator comprises an elevator car which is moved by an elevator drive. During normal operation of the elevator installation, a landing call which is entered by a passenger on a call input landing is detected by the group controller, and is allocated to an elevator. The elevator car of the allocated elevator is moved by the elevator drive to the call input landing of the landing call, in order to allow the passenger to enter the elevator car. Once the passenger has entered the elevator car, he enters a car call for a destination landing in the elevator car, in response to which the elevator drive moves the elevator car to the destination landing. Furthermore, the group controller uses the landing calls and the car calls to estimate the traffic on each landing. The traffic estimation means an estimated amount of traffic to a destination landing, a presence or absence of demands on a landing, a waiting time on a landing, a departure time from a landing, a number of passengers who arrive on one landing or leave a landing, as well as the presence or absence of excessively long waiting times on one landing, or of excessively long departure times from one landing. If there is a large demand on one landing, the elevator installation is changed by the group controller to express operation, and one elevator is removed from the landing call allocation. The elevator car of the removed elevator is moved directly by the elevator drive to the landing with the high demand, in order that passengers can enter the elevator car. Once the passengers have entered the elevator car, the elevator car is moved directly by the elevator drive to a supposed destination landing. A check is then carried out to determine whether the high demand on that landing has or has not decreased. If yes, the group controller changes back from express operation to normal operation of the elevator installation, and the removed elevator is returned to the landing call allocation.

SUMMARY

Some embodiments comprise a method for operation of an elevator installation having at least one elevator, having at least one call input apparatus and a call controller; with a call on a call input landing being transmitted from the call input apparatus to the call controller; in a normal operating mode of the elevator installation, the call controller allocates at least one elevator to the transmitted call, for this purpose, at least one normal operation signal is transmitted by the call controller to the allocated elevator; for a transmitted normal operation signal, at least one elevator controller for the allocated elevator operates at least one elevator car of the allocated elevator to travel to the call input landing. In a busy-period mode of the elevator installation, the call controller transmits at least one main operation signal to at least one elevator; for a main operation signal which is transmitted to an elevator, at least one elevator car of this elevator is operated by at least one elevator controller for this elevator to travel between at least two main operation landings.

This can mean that, in the busy-period mode of the elevator installation, an elevator car is moved only between predefined main operation landings for a main operation signal. This can therefore result in passengers being moved in an economic movement manner between main operation landings. The main operation landings can be freely determined, but in general, the main operation landings are those landings with the greatest amount of traffic.

In some embodiments, at least one traffic signal is transmitted to at least one output apparatus; the traffic signal is output visually and/or audibly as at least one traffic information item on the output apparatus.

This can mean that the passenger is visually and/or audibly informed about the main traffic mode of the elevator installation.

In some embodiments, the traffic information indicates that an elevator car is ready to enter. In some embodiments, the traffic information indicates which elevator cars of a plurality of elevators on a main operation landing are ready to enter. In some embodiments, the traffic information indicates that an elevator car is being prepared for entering. Possibly, the traffic information indicates which elevator cars of a plurality of elevators on a main operation landing are being prepared for entering. Possibly, the traffic information indicates that an elevator car is no longer ready to enter. Possibly, the traffic information indicates which elevator cars of a plurality of elevators on a main operation landing are no longer ready to enter. In some embodiments, the traffic information indicates that an elevator car is not ready to enter. Possibly, the traffic information indicates which elevator cars of a plurality of elevators on a main operation landing are not ready to enter. In some embodiments, the traffic information indicates that an elevator car has been temporarily stopped. In some embodiments, the traffic information indicates which elevator cars of a plurality of elevators have been temporarily stopped. Possibly, the traffic information indicates that an elevator car is not in operation. Possibly, the traffic information indicates which elevator cars of a plurality of elevators are not in operation.

This can mean that the traffic information provides the passenger with a wide range of information items relating to the availability of the elevator installation. An elevator car which is ready to enter can be entered by a passenger through an elevator door that has been opened. An elevator car that is being prepared for entering can be entered by a passenger in a few seconds through an elevator door which has been opened. It was possible for a passenger to enter an elevator car which is no longer ready to enter, up to a few seconds previously, through an elevator door which had been opened. An elevator car which is not ready to enter can admittedly not be entered at that time by a passenger through an elevator door which has been opened, but can again in one or two minutes.

In some embodiments, the traffic information indicates the time sequence in which elevator cars of a plurality of elevators on a main operation landing are ready to enter. Possibly, the traffic information indicates the predetermined arrival time at which an elevator car will move to a main operation landing. Possibly, the traffic information indicates the difference time with respect to an arrival time, on reaching which arrival time an elevator car will move to a main operation landing. Possibly, the traffic information indicates the predetermined departure time at which an elevator car will depart from a main operation landing. Possibly, the traffic information indicates the difference time with respect to a departure time, on reaching which departure time an elevator car will depart from a main operation landing.

This can mean that the traffic information provides the passenger with a wide range of information items relating to the main traffic mode of the elevator installation. Information such as this can be particularly important at busy times when there is a demand for the elevators of the elevator installation.

In some embodiments, the traffic information indicates the predefined number of passengers with which an elevator car will depart from a main operation landing. Possibly, the traffic information indicates the predefined useful load with which an elevator car will depart from a main operation landing. Possibly, the traffic information indicates the difference number from a predefined number of passengers, on reaching which number of passengers an elevator car will depart from a main traffic landing. Possibly, the traffic information indicates the difference number from a predefined useful load, on reaching which useful load an elevator car will depart from a main traffic landing. In some embodiments, the traffic information indicates the predefined number of passengers with which an elevator car will depart from a main operation landing; and, if a predefined departure time is reached before the predefined number of passengers of the elevator car is reached, the elevator car will depart from the main operation landing without reaching the predefined number of passengers. In some embodiments, the traffic information indicates the predefined useful load with which an elevator car will depart from a main operation landing; and, if a predefined departure time is reached before the predefined useful load of the elevator car is reached, the elevator car will depart from the main operation landing without reaching the predefined useful load. In some embodiments, the traffic information indicates after reaching what predetermined time after detection of at least one passenger information item, which is detected by at least one sensor, in an elevator car, this elevator car will depart from a main operation landing. In some embodiments, in that the traffic information indicates after reaching what predetermined time after detection of at least one passenger information item, which is detected by at least one sensor, in an elevator car, this elevator car will move to a main operation landing.

This can mean that the traffic information provides the passenger with a wide range of information items relating to the elevator installation. Depending on the amount of traffic, an elevator car can therefore leave and/or approach a main operation landing earlier or later.

In some embodiments, at least one passenger information item is detected by at least one sensor in at least one detection area; and the sensor transmits at least one sensor signal to the call controller, which sensor signal indicates a passenger information item which has been detected by the sensor in the detection area.

Additional embodiments furthermore relate to an elevator installation for carrying out the method, according to which a passenger information item is detected by a sensor in a detection area; and the sensor transmits a sensor signal to the call controller, which sensor signal indicates a passenger information item which has been detected by the sensor in the detection area; in which case, the sensor is a light sensor and/or a camera and/or an ultrasound sensor and/or an infrared sensor and/or a weighing apparatus and/or a noise-level sensor and/or a transmitting/receiving apparatus.

This can mean that a wide range of sensors can be used to detect passenger information.

In some embodiments, the transmitted sensor signal is read by the call controller into at least one counting register. Possibly, a current number of passengers and/or useful load is maintained in the counting register. Possibly, the transmitted sensor signal is used to estimate a current number of passengers and/or useful load.

This can mean that a current number of passengers and/or useful load is estimated using the passenger information. It can therefore be possible to estimate a current number of passengers and/or useful load from a comparison of images from a camera as sensor signals, assuming an average volume of a passenger. A current number of passengers and/or useful load can also be estimated from the weight on a weighing apparatus as a sensor signal, assuming an average weight of a passenger.

A current number of passengers and/or useful load from at least one landing can be maintained in the counting register. In some embodiments, a current number of passengers and/or useful load of at least one elevator car is maintained in the counting register. Possibly, a current number of passengers and/or useful load of each elevator car of a double-decker arrangement of an elevator is maintained in the counting register. Possibly, a current number of passengers and/or useful load of elevator cars which can be moved independently of one another, one on top of the other, in an elevator shaft, of an elevator, is maintained in the counting register. Possibly, a current number of passengers and/or useful load of the elevator installation is maintained in the counting register. Further embodiments relate to an elevator installation for carrying out the method, according to which the elevator has a double-decker arrangement of elevator cars. Further embodiments relate to an elevator installation for carrying out the method, according to which the elevator has a plurality of elevator cars which can be moved independently of one another, one on top of the other, in an elevator shaft.

This can mean that a counting register maintains a current number of passengers and/or useful load both for areas of the elevator installation and for the overall elevator installation. Various specific elevators can also be operated using the method.

In some embodiments, at least a current number of passengers is stored, provided with at least one time marking, in at least one computer-readable data memory; a current number of passengers which is stored in the computer-readable data memory is identified via the time marking; and at least one current number of passengers, which is stored in the computer-readable data memory, is loaded into the call controller, which time marking corresponds to the stored current number of passengers at a current clock time. Possibly, at least a current useful load is stored, provided with at least one time marking, in at least one computer-readable data memory; a current useful load which is stored in the computer-readable data memory is identified via the time marking; and at least one current useful load, which is stored in the computer-readable data memory, is loaded into the call controller, whose time marking corresponds to a current clock time.

This can mean that there is no need to detect the current number of passengers and/or useful load for recurring elevator installation traffic, since a stored reference is accessed.

In some embodiments, an elevator car which is operated in the busy-period mode of the elevator installation is positioned with the elevator door open on at least one main operation landing.

This can mean that, in the busy-period mode, passengers can enter an elevator car which is waiting with the elevator door open, without having to make a call.

In some embodiments, an elevator car is operated in the busy-period mode of the elevator installation such that it moves to a main operation landing at predetermined arrival times. Possibly, an elevator car is operated in the busy-period mode of the elevator installation such that it departs from a main operation landing at predetermined departure times. Possibly, an elevator car is operated in the busy-period mode of the elevator installation such that it departs from a main operation landing at regular departure times. Possibly, an elevator car is operated in the busy-period mode of the elevator installation such that it moves to the main operation landings in a predetermined sequence. Possibly, an elevator car is operated in the busy-period mode of the elevator installation such that it moves to a main operation landing again only once it has moved to at least one other main operation landing. Possibly, an elevator car is operated in the busy-period mode of the elevator installation such that it departs from a main operation landing as soon as at least a predefined passenger information item is detected in the elevator car.

In some embodiments, an elevator car which is operated in the busy-period mode of the elevator installation departs from a main operation landing as soon as at least one predefined passenger information item is detected in the elevator car; and, if a predetermined departure time is reached before the predefined passenger information item for the elevator car is reached, the elevator car departs from the main operation landing without reaching the predefined passenger information item. Possibly, an elevator car which is operated in the busy-period mode of the elevator installation departs from a main operation landing as soon as at least one predetermined time after detection of at least one passenger information item in the elevator car has been reached in the elevator car. Possibly, an elevator car which is operated in the busy-period mode of the elevator installation moves to a main operation landing as soon as at least one predetermined time after detection of at least one passenger information item in the elevator car has been reached in the elevator car.

This can mean that, in the busy-period mode, the elevator installation is convenient for passengers and/or is operated in accordance with rules which can easily be understood by the passenger.

In some embodiments, the call controller checks whether a current number of passengers is greater than at least one traffic-technical threshold value; and, if the current number of passengers is greater than the traffic-technical threshold value, the elevator installation is operated in the busy-period mode. Possibly, the call controller checks whether a current useful load is greater than at least one traffic-technical threshold value; and, if the current useful load is greater than the traffic-technical threshold value, the elevator installation is operated in the busy-period mode. Possibly, the call controller checks whether a current number of passengers is less than or equal to at least one traffic-technical threshold value; if the current number of passengers is less than or equal to the traffic-technical threshold value, the elevator installation is operated in the normal operating mode. Possibly, the call controller checks whether a current useful load is less than or equal to at least one traffic-technical threshold value; if the current useful load is less than or equal to the traffic-technical threshold value, the elevator installation is operated in the normal operating mode.

This can mean that a traffic-technical threshold value controls whether a call is or is not taken into account. If the traffic-technical threshold value is overshot, an elevator car is moved alternately between predefined main operation landings, which corresponds to the high movement-economic busy-period mode of the elevator installation. A call is taken into account, for example, only when the traffic-technical threshold value is not overshot, and this corresponds to the normal operating mode of the elevator installation.

In some embodiments, the traffic-technical threshold value denotes an upper load-level limit of the elevator installation, at which a capacity, which is specific to the elevator installation, is undershot by the current number of passengers and/or useful load by a factor of 5, possibly 3, and possibly 2.

This can mean that a traffic-technical threshold value can be set specifically for a capacity which is specific to the elevator installation, and can therefore be preset.

In some embodiments, the call controller checks whether a current number of passengers is less than or equal to at least one energy-technical threshold value; and, if the current number of passengers is less than or equal to the energy-technical threshold value, the call controller temporarily stops at least one elevator. In some embodiments, the call controller checks whether a current useful load is less than or equal to at least one energy-technical threshold value; and, if the current useful load is less than or equal to the energy-technical threshold value, the call controller temporarily stops at least one elevator. In some embodiments, the energy-technical threshold value denotes a lower load-level limit of the elevator installation, at which a capacity, which is specific to the elevator installation, is undershot by the current number of passengers and/or by a factor of 20, possibly 10, and possibly 6 useful load the call controller checks whether a current. In some embodiments, the number of passengers is greater than at least one energy-technical threshold value; and, if the current number of passengers is greater than the energy-technical threshold value, the elevator installation is operated in the normal operating mode. Possibly, the call controller checks whether a current useful load is greater than at least one energy-technical threshold value; and, if the current useful load is greater than the energy-technical threshold value, the elevator installation is operated in the normal operating mode.

This can mean that an energy-technical threshold value also controls the operation of the elevator installation. Particularly when there is little traffic, the elevator installation consumes a large amount of energy in standby, which energy consumption can be deliberately minimized by taking account of the current number of passengers and/or useful load in a secondary operating mode of the elevator installation.

In some embodiments, the call controller checks whether a current clock time of the elevator installation is within at least one predetermined main operating time period; and, if the current clock time of the elevator installation is in the predetermined main operating time period, the elevator installation is operated in the busy-period mode. In some embodiments, the call controller checks whether at least one busy-period mode switch of the elevator installation is activated; and, if the busy-period mode switch of the elevator installation is activated, the elevator installation is operated in the busy-period mode. In some embodiments, the call controller checks whether a current clock time of the elevator installation is within at least one predetermined normal operating time period; and, if the current clock time of the elevator installation is within the predetermined normal operating time period, the elevator installation is operated in the normal operating mode. In some embodiments, the call controller checks whether at least one normal operating mode switch of the elevator installation is activated; and, if the normal operating mode switch of the elevator installation is activated, the elevator installation is operated in the normal operating mode. In some embodiments, the call controller checks whether a current clock time of the elevator installation is within at least one predetermined secondary operating time period; and, if the current clock time of the elevator installation is within the predetermined secondary operating time period, the call controller temporarily stops at least one elevator. In some embodiments, the call controller checks whether at least one secondary operating mode switch of the elevator installation is activated; and, if the secondary operating mode switch of the elevator installation is activated, the call controller temporarily stops at least one elevator.

This can mean that it is possible to change deliberately between the normal operating mode, the busy-period mode and the secondary operating mode of the elevator installation by setting of freely variable time periods and/or interactively by activation of switches. The switches may be part of the call controller, and may be operated by a building administrator.

In some embodiments, in the normal operating mode of the elevator installation, at least one elevator is allocated by the call controller to a call transmitted by the call input apparatus. Possibly, the call input apparatus receives at least one code and transmits it to the call controller; in the normal operating mode, the call controller associates at least one call with the transmitted code; and the call controller allocates at least one elevator to the associated call. Possibly, in the busy-period mode of the elevator installation, at least one elevator is allocated by the call controller to a call transmitted by the call input apparatus. Possibly, the call input apparatus receives at least one code and transmits it to the call controller; in the busy-period mode of the elevator installation, the call controller associates at least one call with the transmitted code; and the call controller allocates at least one elevator to the associated call.

This can mean that, both in the normal operating mode and in the busy-period mode, a call can be entered in a number of different manners either directly on a call input apparatus, and/or can be transmitted indirectly by means of a code.

In some embodiments, in the busy-period mode of the elevator installation, the call controller allocates at least one elevator to the transmitted call and/or code only if a capacity, which is specific to the elevator installation, of the elevator is undershot by the current number of passengers in and/or useful load of the elevator by a factor of 5, possibly 3, and possibly 2. In some embodiments, in the busy-period mode of the elevator installation, the call controller allocates at least one elevator to the transmitted call and/or code only if the movement to serve the call is between at least two main operation landings. In some embodiments, in the busy-period mode of the elevator installation, the call controller allocates at least one elevator to the transmitted call and/or code, for example, only if the transmitted call and/or code is associated with a VIP passenger profile.

This can mean that calls or codes can also be served deliberately by the elevator installation in the main traffic mode.

In some embodiments, the call controller takes account of a destination call as a call; and the call controller determines for the destination call at least one best call allocation for a movement by at least one elevator car from a waiting time and/or departure landing to an arrival landing with as short a waiting time and/or time to the destination as possible. Possibly, the waiting time is a time period between a call input and opening of an elevator door of the elevator car of the elevator allocated to the destination call, on the departure landing. Possibly, the time to the destination is a time period between a call input and opening of an elevator door of the elevator car of the elevator allocated to the destination call, on the arrival landing. Further embodiments comprise an elevator installation for carrying out the method, according to which the call controller is a destination call controller.

This can mean that the call controller is a destination call controller, which can allow particularly efficient optimization of the waiting time and/or of the time to the destination.

In some embodiments, the call controller transmits at least one traffic signal to at least one output apparatus for a call, which output apparatus is in the vicinity of the call input apparatus which has transmitted the call to the call controller. Further embodiments comprise an elevator installation for carrying out the method, according to which the call controller transmits at least one traffic signal to at least one output apparatus for a call; with the output apparatus being part of the call input apparatus and/or with the output apparatus being part of the elevator car and/or with the output apparatus being part of a door frame of an elevator door and/or with the output apparatus being part of a doorpost of an elevator door and/or with the output apparatus being arranged in an area in front of the elevator.

In some embodiments, the call controller transmits at least one traffic signal to at least one output apparatus for a call, which output apparatus is in the vicinity of the call input apparatus which has transmitted a code to the call controller, with which transmitted code the call controller has associated at least one call.

This can mean that the passenger receives feedback in the form of a traffic signal for a call which has been made and/or for a transmitted code.

In some embodiments, the transmitted traffic signal is output visually and/or audibly as at least one traffic information item on the output apparatus. Possibly, the traffic information indicates that a call and/or code transmitted to the call controller is being served by the elevator installation. Possibly, the traffic information indicates which elevator car is serving a call and/or code transmitted to the call controller, on which departure landing. Possibly, the traffic information indicates at least one movement description from a call input landing to a departure landing, from which departure landing an elevator car will depart in order to serve a call and/or code transmitted to the call controller. Possibly, the traffic information indicates which elevator car will serve a call and/or code transmitted to the call controller, with a movement to which arrival landing. Possibly, the traffic information indicates at least one movement description from an arrival landing to a destination landing, which arrival landing an elevator car will move to in order to serve a call and/or code transmitted to the call controller.

This can mean that the passenger is provided with an indication of the elevator car which will serve his call and/or code, as well as the departure landing and/or the arrival landing of the movement of the elevator car.

In some embodiments, the traffic information indicates the departure time from a departure landing at which an elevator car which will serve a call and/or code transmitted to the call controller. In some embodiments, the traffic information indicates the difference time from a departure time from a departure landing after which an elevator car will serve a call and/or call transmitted to the call controller. In some embodiments, the traffic information indicates the arrival time on an arrival landing at which an elevator car will serve a call and/or code transmitted to the call controller. In some embodiments, the traffic information indicates the difference time from an arrival time on an arrival landing after which an elevator car will serve a call and/or code transmitted to the call controller.

This can mean that the passenger is also provided with information about the movement from the call input landing to the departure landing and/or the movement from the arrival landing to the destination landing desired by the passenger on the basis of the call and/or code.

In some embodiments, a computer program product comprises at least one computer program means, which is suitable for carrying out the method for operation of an elevator installation, in that at least one method step is carried out when the computer program means is loaded into the processor of a call input apparatus and/or of a call controller. In some embodiments, the computer-readable data memory comprises a computer program product such as this.

BRIEF DESCRIPTION OF THE DRAWINGS

Exemplary embodiments of the disclosed technologies will be explained in detail with reference to the figures in which, in some cases in schematic form:

FIG. 5 shows a third view of a part of the landing of the elevator installation shown in FIG. 2 with a plurality of sensors;

FIG. 6 shows an illustration of the communication of the call input apparatus, sensors and of the elevator drive with the call controller for the elevator installation shown in FIG. 1;

DETAILED DESCRIPTION

Figure 1:
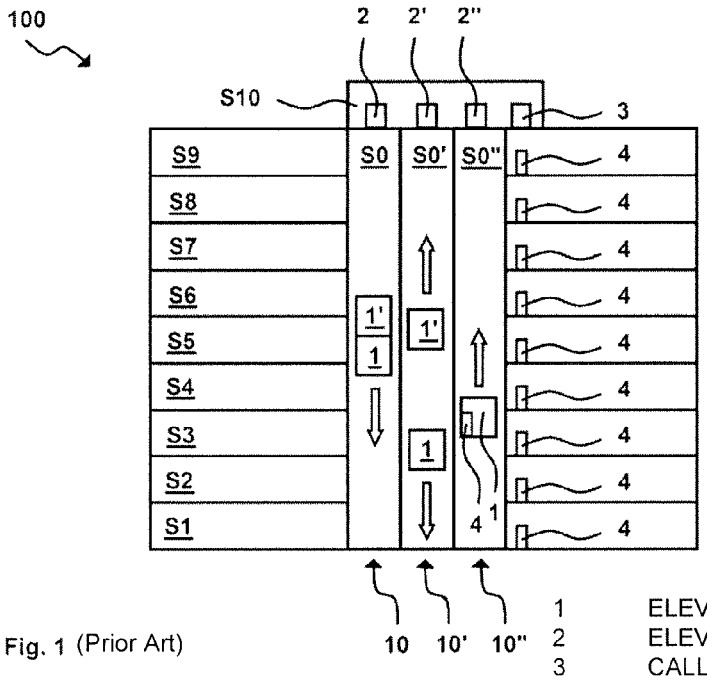
Fig. 1 (Prior Art)
FIG. 1 shows a view of a part of an elevator installation for carrying out a method.

FIG. 1 shows one exemplary embodiment of an elevator installation 100 having at least one elevator 10, 10', 10" in a building. Each elevator 10, 10', 10" has at least one elevator car 1, 1' for each elevator shaft S0, S0', S0". The elevator car 1, 1' can be moved individually in the elevator shaft S0, S0', S0", or as multiple elevator cars, as indicated by vertical direction arrows. An elevator 10 having two elevator cars 1, 1' in a double-decker arrangement is illustrated in the elevator shaft S0'. An elevator 10' having two elevator cars 1, 1', which can be moved independently of one another in the elevator shaft S0' and are arranged one on top of the other, are arranged in the elevator shaft S0'. An elevator 10" with a single elevator car 1 is arranged in the elevator shaft S0". The building has a relatively great number of landings S1 to S9. A passenger can enter and/or leave an elevator car 1, 1' via at least one elevator door on each of the landings S1 to S9. With knowledge of the present disclosure, a person skilled in the art can also implement other elevator types, such as a triple elevator arrangement, an elevator having more than two cars which can be moved independently of one another in one elevator shaft, etc.

At least one elevator controller 2, 2', 2" is arranged in at least one machine area S10 for each elevator 10, 10', 10", and at least one call controller 3 is arranged there for the elevator installation 100. The call controller 3 has at least one processor and at least one computer-readable data memory. At least one computer program means is loaded into the processor from the computer-readable data memory, and is run. The computer program means operates the elevator controller 2, 2', 2" for the elevator car 1, 1'. Operating the elevator controller 2, 2', 2" results in the elevator car 1, 1' being moved in the elevator shaft S0, S0', S0", and in at least one elevator door being opened and closed when stopped on a landing. At least one shaft information item provides the call controller 3 with information items relating to the current position of the elevator car 1, 1' in the elevator shaft S0, S0', S0". Furthermore, the call controller 3 has at least one signal bus adapter for at least one signal bus and at least one electrical power supply. Each subscriber to the communication in the signal bus has a unique address. The signal bus is, for example, a fixed network such as a LON bus using the LON protocol, and/or an Ethernet network using the Transmission Control Protocol/Internet Protocol (TCP/IP) and/or an Attached Resources Computer Network (ARCNET), etc. However, the signal bus may also be a local radio network with a reception range of up to 300 meters, such as Bluetooth (IEEE 802.15.1) and/or ZigBee (IEEE 802.15.4) and/or Wi-Fi (IEEE 802.11) using a frequency, for example, of 800/900 MHz or 2.46 GHz. Bidirectional communication is possible in the radio network, in known and proven network protocols, such as the Transmission Control Protocol/Internet Protocol (TCP/IP) and/or Internet Packet Exchange (IPX). The computer program means controls the signal bus adapter and the electrical power supply. The elevator door, the shaft information, the signal bus adapter, the signal bus, the electrical power supply and further components of an elevator, such as a counterweight, a drive and supporting means, an elevator drive, a door drive, etc., are not shown in the illustration in FIG. 1, for clarity reasons. Details relating to the signal bus are illustrated in FIG. 6.

Figure 2:
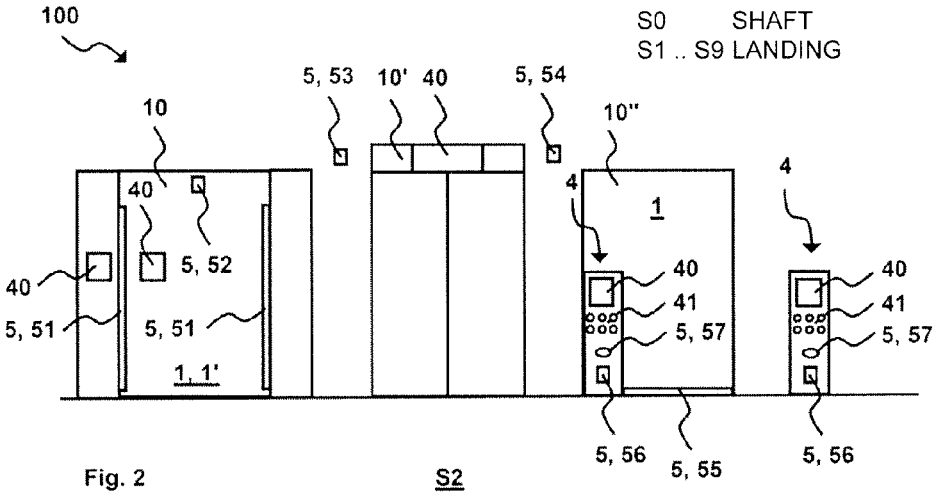
FIG. 2 shows a view of a part of a landing of the elevator installation shown in FIG. 1.
Figure 3:
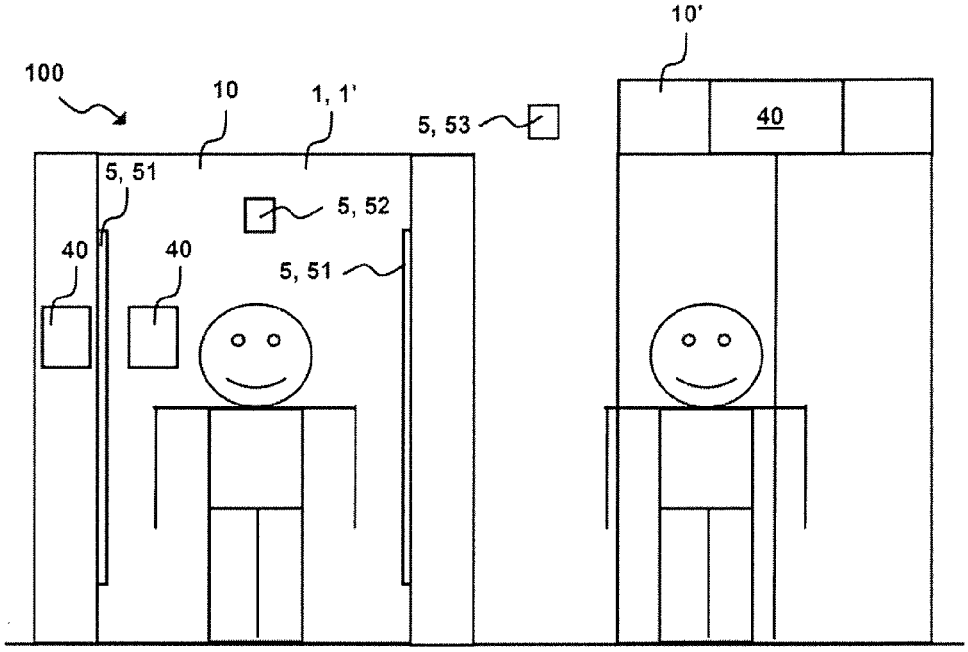
FIG. 3 shows a first view of a part of the landing of the elevator installation shown in FIG. 2 with a plurality of sensors.
Figure 4:
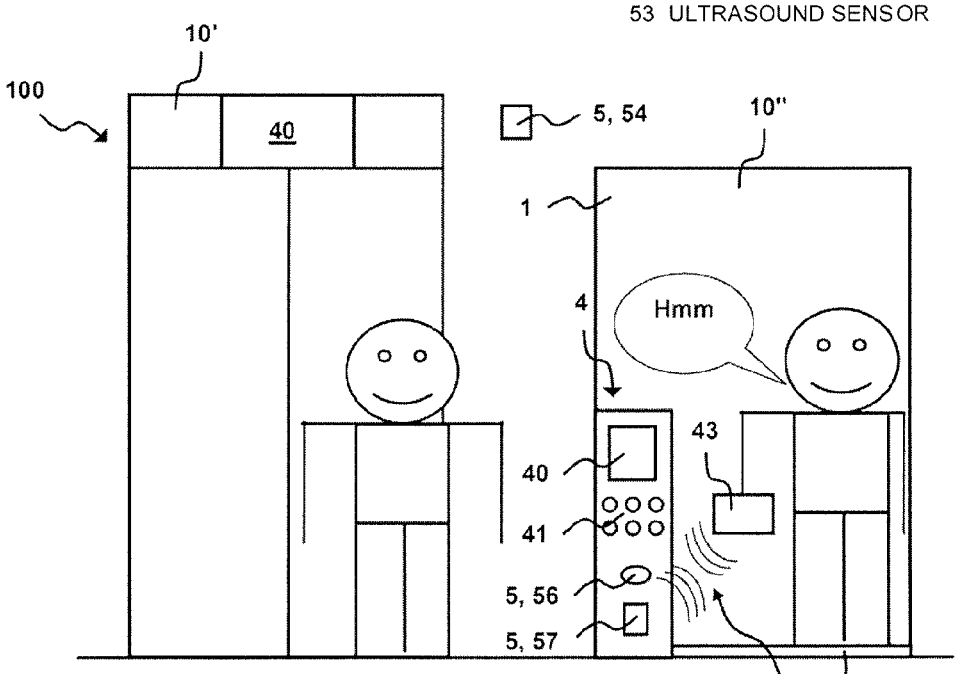
FIG. 4 shows a second view of a part of the landing of the elevator installation shown in FIG. 2 with a plurality of sensors.

As is shown in FIG. 1, at least one call input apparatus 4 is arranged stationary close to an elevator door, on each landing S1 to S9. FIG. 2 shows a part on the landing S2 of the elevator installation 100 shown in FIG. 1. The call input apparatus 4 may be mounted on a building wall or is positioned in an isolated form, close to an elevator door, as illustrated in FIG. 2. As shown in FIGS. 1 and 2, a call input apparatus 4 is arranged in the elevator car 1 of the elevator 10". At least one signal bus adapter for at least one signal bus, at least one input apparatus 41, at least one output apparatus 40 and at least one electrical power supply are arranged in a housing of the call input apparatus 4. Furthermore, at least one transmitting/receiving apparatus 57 for at least one radio field can be arranged in the housing of the call input apparatus 4. The call input apparatus 4 has at least one processor and at least one computer-readable data memory. At least one computer program means is loaded into the processor from the computer-readable data memory, and is run. The computer program means controls the signal bus adapter, the input apparatus 41, the output apparatus 40, the transmitting/receiving apparatus 57 and the electrical power supply. As is shown in FIG. 1, the call controller 3 is an autonomous electronic apparatus in its own housing. The call controller 3 may also be an electronic insert, for example in the form of a printed circuit board, which printed circuit board is pushed in in a housing of a call input apparatus 4. The signal bus adapter, the signal bus, the electrical power supply and the radio field are not shown in the illustration in FIG. 2, for clarity reasons. Details relating to the signal bus are illustrated in FIG. 6. The output apparatus 40 may also be an autonomous unit and, for example, as shown in FIGS. 2 and 3, may be part of the elevator car 1, 1' and/or, as shown in FIGS. 2 and 3, may be part of a door frame at the side of an elevator door and/or, as shown in FIGS. 2 and 4, may be part of a doorpost above an elevator door. The output apparatus 40 may also be arranged in an area in front of the elevator 10, 10', 10", such as a lobby, entrance hall etc. An output apparatus 40 in the form of an autonomous unit likewise has at least one signal bus adapter for at least one signal bus, and at least one electrical power supply.

FIG. 2 shows the elevators 10, 10', 10" on the landing S2. The elevator doors of the two outer elevators 10, 10" are open and show a part of the elevator car 1, 1', with the elevator door of the central elevator 10' being closed. At least one sensor 5 for the elevator installation 100 detects at least one passenger information item in at least one detection area of the elevator installation 100, and produces at least one sensor signal for this passenger information item. The sensor 5 is a light sensor 51 and/or a camera 52 and/or an ultrasound sensor 53 and/or an infrared sensor 54 and/or a weighing apparatus 55 and/or a noise-level sensor 56 and/or a transmitting/receiving apparatus 57. The sensor 5 has at least one processor, at least one computer-readable data memory, at least one signal bus adapter for at least one signal bus, and at least one electrical power supply. At least one computer program means is loaded into the processor from the computer-readable data memory, and is run. The computer program means controls the sensor 5, the signal bus adapter and the electrical power supply. Embodiments of the sensor 5 will be explained in the following text with reference to FIGS. 2 to 5, by way of example:

- the light sensor 51 operates on the basis of the photoelectric effect and is, for example, a photodiode or a photo transistor. The light sensor 54 measures the brightness in the range, for example, of from ten lux to 1500 lux, with a resolution of ± one percent. The light sensor 51 as shown in FIGS. 2 and 3, by way of example, is a light curtain for monitoring an area above the threshold of the elevator door. In this area, two strips with photodiodes and phototransistors, which are arranged at the side adjacent to the elevator door, transmit and receive infrared light. As soon as a passenger crosses the threshold of the elevator door on entering or leaving the elevator car 1, 1', the reception of the transmitted infrared light is interrupted in places, and a sensor signal is produced.
- the camera 52 has at least one optical lens and at least one digital image sensor. The digital image sensor is, for example, a charge coupled device (CCD) sensor, or a complementary metal-oxide semiconductor (CMOS) sensor. The camera 52 detects images in the spectrum of visible light. The camera 52 can detect stationary images or moving images at a frequency from 0 to 30 images per second. At least one computer program means is loaded into a processor in the camera 52 from a computer-readable data memory in the camera 52, and is run. The computer program means controls the operation of the camera 52, stores and loads stationary images, compares stationary images with one another and can produce at least one signal state change as the comparison result. The camera 52 has, for example, a resolution of two MPixels, and, for example, a sensitivity of two lux. The camera 52 has a motor-operated zoom objective and can therefore vary the focal length of the objective automatically or by remote control. This makes it possible to detect objects at different distances, with image sections of different detail. The camera 52 has a motor-operated tripod, in order in this way to vary the orientation of the objective, automatically or by remote control. By way of example, the camera 52 is panned or is rotated. The camera 52 is provided with a lighting device and can thus illuminate an object to be detected when the ambient light is weak, or it is dark. As shown in FIGS. 2 and 3, the camera 52 is arranged in the elevator car 1, 1' and detects a passenger entering or leaving the elevator car 1, 1', as a sensor signal in the form of at least one image.
- the ultrasound sensor 53 operates on the basis of echo delay-time measurement and for this purpose uses, for example, an energized membrane. When the ultrasound waves transmitted from the membrane strike an object, then they are reflected, and the reflected ultrasound waves are detected. A distance between the membrane and the object is determined from the delay time between the transmitted ultrasound waves and the detected reflected ultrasound waves. The ultrasound sensor 53 detects movements with, for example, a resolution of one millimeter. As shown in FIGS. 2 and 3, the ultrasound sensor 53 is arranged in the vicinity of the elevator installation 100, and detects a passenger in an area in front of the elevator doors of the elevators 10, 10', as a sensor signal.
- the infrared sensor 54 contactlessly detects heat radiation in, for example, a temperature measurement range from −30° C. to +500° C., with a resolution of ± one percent. The infrared sensor 51 produces thermal images of the heat radiation emitted by passengers. As shown in FIGS. 2 and 4, the infrared sensor 54 is arranged in the vicinity of the elevator installation 100 and detects a passenger in an area in front of the elevator doors of the elevators 10', 10", as a sensor signal.
- the weighing apparatus 55 is, for example, a load-sensitive mat, which detects the weight of a user standing on it, in kilograms. Load-sensitive mats such as these have various dimensions. For example, a load-sensitive mat has a rectangular base area of 0.5 square meters, and a thickness of two centimeters, and detects a weight in the range from one kilogram to 200 kilograms. As shown in FIGS. 2 and 4, the weighing apparatus 56 is arranged in a landing of the elevator car 1, 1' and detects a passenger entering or leaving the elevator car 1, 1', as a sensor signal.
- the noise-level sensor 56 detects intensities and noise levels. Intensities are detected with, for example, a resolution from $10^{-3}$ $\mu Wm^2$ to $10^{+4}$ $\mu Wm^2$, and the noise level is detected, for example, in a range from 30 dB to 110 dB, with, for example, a resolution of 0.1 dB. As shown in FIGS. 2, 4 and 5, the noise-level sensor 56 is a component of the call input apparatus 4, and detects a noise from a passenger in the vicinity of the call input apparatus 4, for example a "Hmm", as shown in FIGS. 4 and 5, as a sensor signal.
- the transmitting/receiving apparatus 57 is, for example, a component of the call input apparatus 4 and communicates in the radio field 42 with at least one mobile communication apparatus 43, which is carried by the user. The mobile communication apparatus 43 has at least one processor and at least one computer-readable data memory. At least one computer program means is loaded into the processor from the computer-readable data memory, and is run. The computer program means controls the communication of the mobile communication apparatus 43 in the radio field 42. As shown in FIGS. 2 and 5, this communication is represented by curved triple circle segments. A plurality of embodiments are possible in this case:

+ in a first embodiment, the mobile communication apparatus 43 is, for example, a radio frequency identification (RFID) card worn by the user and having at least one coil. The radio frequency which is used by the transmitting/receiving apparatus 57 is, for example, 125 kHz, 13.56 MHz, 2.45 GHz, etc. Via its coil, the mobile communication apparatus 43 inductively receives energy from the electromagnetic field of the transmitting/receiving apparatus 57, and is thus energetically activated. The energetic activation takes place automatically, as soon as the mobile communication apparatus 43 is within the reception area of the electromagnetic field from a few centimeters up to one meter from the transmitting/receiving apparatus 57. As soon as the mobile communication apparatus 43 has been energetically activated, the processor in the mobile communication apparatus 43 reads at least one code, which is stored in the data memory and is sent via the coil to the transmitting/receiving apparatus 57. The energetic activation of the mobile communication apparatus 43 and the transmission of the code to the transmitting/receiving apparatus 57 take place contactlessly. The transmitting/receiving apparatus 57 detects the code as a sensor signal.
+ in a second embodiment, the mobile communication apparatus 43 is, for example, a mobile telephone which is carried by the user and/or a computer with at least one electrical power supply. Local radio networks such as Bluetooth and/or ZigBee and/or Wi-Fi may be used for communication of the mobile telephone and/or computer in the radio field 42. The radio field 42 allows bidirectional communication in accordance with known and proven network protocols such as the Transmission Control Protocol/Internet Protocol (TCP/IP) or Internet Packet Exchange (IPX). As soon as the mobile communication apparatus 43 is located in the radio field 42, the processor reads a code which is stored in the data memory and is transmitted to the transmitting/receiving apparatus 57. The transmitting/receiving apparatus 57 detects the code as a sensor signal.

With knowledge of the present disclosure, the arrangement of the sensors 5, 51 to 57, illustrated by way of example, can be combined and/or varied as required, of course. For example, the camera 52 and/or the weighing apparatus 55 may also be arranged outside the elevator car 1, 1', in the area in front of an elevator 10, 10', 10". In addition, an ultrasound sensor 53 and/or an infrared sensor 54 may be arranged in an elevator car 10, 10'. Finally, a light sensor 51 can also be arranged in the area in front of an elevator 10, 10', 10". The sensor 5 can be arranged at a greater distance of 50 or 100 meters away from the elevator 10, 10', 10", and it can thus detect a passenger when approaching the elevator car 1, 1', 1". The sensor 5 may have further features. For example, the noise-level sensor 56 may be a microphone which is coupled to voice recognition, such that at least one letter and/or number and/or word spoken by the passenger is identified as a sensor signal. Other sensors, which are not illustrated here, can also be used, such as a biometric fingertip sensor, which detects a profile of a fingertip of a passenger as a sensor signal, or a biometric iris sensor, which detects an image of the iris of the passenger as a sensor signal.

As shown in FIG. 6, the call controller 3 communicates with the elevator controller 2, 2', 2" in the machine area S10 via at least one signal bus 31. A call input apparatus 4, which is arranged on the landings S1 to S9, communicates with the call controller 3 via a signal bus 31'. A sensor 5, such as a noise-level sensor 56 and/or transmitting/receiving apparatus 57, which is arranged in the call input apparatus 4 on a landing S1 to S9, likewise communicates with the call controller 3 via the signal bus 31'. A sensor 5 such as a light sensor 51 and/or a camera 52 and/or a weighing apparatus 55, which is arranged in an elevator car 1, 1', communicates with the call controller 3 via a signal bus 31". An output apparatus 40, which is arranged as an autonomous unit in the elevator car 1, 1', also communicates with the call controller 3 via the signal bus 31". A sensor 5, such as a noise-level sensor 56 and/or transmitting/receiving apparatus 57, which is arranged in the call input apparatus 4 of the elevator car 1 of the elevator 10", likewise communicates with the call controller 3 via the signal bus 31". A sensor 5, such as an ultrasound sensor 53 and/or an infrared sensor 54, which is arranged on the landings S1 to S9, communicates with the call controller 3 via a signal bus 31". An output apparatus 40, which is arranged as an autonomous unit on the landings S1 to S9, likewise communicates with the call controller 3 via a signal bus 31'". The signal bus 31, 31', 31", 31'" may be a fixed network such as a LON bus and/or an Ethernet Network and/or an ARCNET. The signal bus 31, 31', 31", 31'" may also be a local radio network, such as Bluetooth and/or ZigBee and/or Wi-Fi. By way of example, the signal bus 31 in the machine area S10 consists of at least one electrical data cable in at least one cable duct. The signal bus 31' of the call input apparatus 4, which is arranged on landings S1 to S9, together with a sensor 5 such as a noise-level sensor 56 and/or a transmitting/receiving apparatus 57 consists, for example, of at least one electrical cable laid under the plaster. The signal bus 31" of the elevator car 1, 1' of the elevator 10, together with a sensor 5 such as a light sensor 51 and/or a camera 52 and/or a weighing apparatus 55, as well as that of the elevator car 1 of the elevator 10", together with a call input apparatus 4 with a sensor 5 such as a noise-level sensor 56 and/or a transmitting/receiving apparatus 57, consist, for example, of at least one electrical suspended cable, which is arranged in the elevator shaft S0, S0', S0". The signal bus 31'" of the sensor 5, such as an ultrasound sensor 53 and/or an infrared sensor 54, which is arranged on landings S1 to S9 consists, for example, of a local radio network.

With knowledge of the present disclosure, a person skilled in the art can also implement a greater or lesser number of signal buses. In principle, a single signal bus is sufficient for communication with the subscribers.

As shown in FIGS. 2 and 5, the call input apparatus 4 has a plurality of keys as an input apparatus 41, by means of which the passenger can enter a call by hand, using at least one numerical sequence. The call which is entered on the call input apparatus 4 is transmitted, as shown in FIG. 6, in the signal bus 31', 31" to the call controller 3. The call may be a landing call, a car call or a destination call. However, it is also possible to make a call contactlessly on the call input apparatus 4 by the transmitting/receiving apparatus 57 reading the code of the mobile communication apparatus 43 carried by the passenger. The code received by the call input apparatus 4 for the call input landing is also transmitted to the call controller 3 in the signal bus 31', 31", as shown in FIG. 6. The call controller 3 associates at least one call with the transmitted code. By way of example, the call controller 3 associates a transmitted code with a passenger profile which has at least one predefined call. The passenger profile may also have further details relating to the passenger. For example, the passenger profile may contain an indication as to whether the passenger is a very important person (VIP) and/or as to whether the passenger is disadvantaged, for example disabled. The passenger profile can be stored in the computer-readable data memory in the call controller 3. The predefined call can be loaded from the passenger profile.

In the illustrated exemplary embodiments, the two elevators 10, 10' serve destination calls, while the elevator 10" serves landing calls and car calls. With knowledge of the present disclosure a person skilled in the art may, of course, also implement elevator installations in which all the elevators serve destination calls or all serve landing calls and car calls. The call controller 3 allocates an elevator 10, 10', 10" to a landing call or destination call. For call allocation, at least one computer program means is loaded from the computer-readable data memory in the call controller 3 into the processor in the call controller 3, and is run. The computer program means produces at least one normal operation signal for call allocation. As is shown in FIG. 6, the call controller 3 transmits the normal operation signal in the signal bus 31 to the elevator controller 2, 2', 2" for the allocated elevator 10, 10', 10". The normal operation signal is used to operate the elevator controller 2, 2', 2" of the allocated elevator 10, 10', 10", and to move the elevator car 1, 1' of the allocated elevator 10, 10', 10".

In the case of a landing call as shown in FIGS. 1 and 2, an elevator car 1 of the allocated elevator 10" is moved to the call input landing of the call input apparatus 4, at which call input apparatus 4 the landing call has been made and/or which call input apparatus 4 has received the code with which a landing call has been associated. Once the passenger has entered the elevator car 1, a car call to a destination landing desired by the passenger is made on the call input apparatus 4 in the elevator car 1 of the elevator 10", and the elevator car 1 is moved to this destination landing by the elevator controller 2" for this car call. The car call can also be received as a code, and transmitted to the call controller 3, from the call input apparatus 4 in the elevator car 1 of the elevator 10". The call controller 3 associates at least one car call with the received code of the call input apparatus 4 of the elevator car 1 of the elevator 10", and transmits the car call in the signal bus 31 to the elevator controller 2", in order that it moves the elevator car 1 of the elevator 10" to the destination landing in accordance with the car call.

In the case of a destination call, the entry of the call itself defines the call input landing and a destination landing desired by the passenger, as a result of which there is no longer any need for a car call. The call controller 3 therefore knows the destination landing even when the call entry is made, and can therefore optimize not only the approach to the call input landing but also that to the destination landing.

In a normal traffic mode, the call controller 3 determines at least one movement from a departure landing to an arrival landing for a call. A best call allocation denotes a movement by at least one elevator car 1, 1' from a departure landing to an arrival landing with as short a waiting time as possible, and/or with as short a time to the destination as possible. An elevator 10, 10', 10" is therefore allocated to the call. The waiting time is the time period between the call input and opening of an elevator door of the elevator car 1, 1' of the elevator 10, 10', 10" allocated to that call, on the departure landing. The time to the destination is the time period between the call input and opening of an elevator door of the elevator car 1, 1' of the elevator 10, 10', 10" allocated to that call, on the arrival landing. The departure landing need not correspond to the call input landing. In addition, the arrival landing need not correspond with the destination landing desired by the passenger on the basis of the destination call. In order to determine the best movement, at least one computer program means is loaded from the computer-readable data memory in the call controller 3 into the processor in the call controller 3, and is run. The computer program means produces at least one normal operation signal for the best movement. As shown in FIG. 6, the call controller 3 transmits the normal operation signal in the signal bus 31 to the elevator controller 2, 2', 2" for the allocated elevator 10, 10', 10". The normal operation signal is used to operate the elevator controller 2, 2', 2" for the allocated elevator 10, 10', 10", and to move the elevator car 1, 1' of the allocated elevator 10, 10' to the departure landing and arrival landing.

As shown in FIG. 6, the call controller 3 transmits at least one traffic signal in the signal bus 31', 31", 31'" to an output apparatus 40. With the traffic signal, at least one traffic information item is output to the passenger on the output apparatus 40. The passenger therefore receives visual and/or audible traffic information on the output apparatus 40. The traffic information therefore informs the passenger of the predetermined arrival time at which an elevator car 1, 1' will move to a main operation landing and/or what the difference time is from an arrival time, on reaching which arrival time an elevator car 1, 1' will move to a main operation landing, and/or the predetermined departure time at which an elevator car 1, 1' will depart from a main operation landing and/or the difference time with respect to a departure time, on reaching which departure time an elevator car 1, 1' will depart from a main operation landing, and/or the predefined number of passengers with which an elevator car 1, 1' will depart from a main operation landing and/or the difference number from a predefined number of passengers, on reaching which number of passengers an elevator car 1, 1' will depart from a main operation landing, and/or the predefined useful load with which an elevator car 1, 1' will depart from a main operation landing and/or the difference number from a predefined useful load, on reaching which useful load an elevator car 1, 1' will depart from a main operation landing, and/or the predefined number of passengers with which an elevator car 1, 1' will depart from a main traffic landing, and, if a predefined departure time is reached before the predefined number of passengers of the elevator car is reached, the elevator car will depart from the main traffic landing without reaching the predefined number of passengers and/or the predefined useful load with which an elevator car 1, 1' will depart from a main traffic landing, and, if a predetermined departure time is reached before the predefined useful load of the elevator car is reached, the elevator car will depart from the main traffic landing without reaching the predefined useful load and/or after reaching what predetermined time after detection of at least one passenger information item, which is detected by at least one sensor 5, in an elevator car, this elevator car will depart from a main traffic landing and/or after reaching what predetermined time after detection of at least one passenger information item, which is detected by at least one sensor 5, in an elevator car, this elevator car will move to a main traffic landing, etc. With the traffic information, the passenger also receives, by way of example, a call acknowledgement for the entered call and/or a call acknowledgement for the code read. For example, the traffic information can indicate that a call and/or code transmitted to the call controller 3 is being served by the elevator installation; and/or which elevator car 1, 1' is serving a call and/or code transmitted to the call controller 3, on which departure landing, and/or which elevator car 1, 1' will serve a call and/or code transmitted to the call controller 3, with a movement to which arrival landing. In addition, the traffic information can indicate at least one movement description from a call input landing to a departure landing, from which departure landing an elevator car 1, 1' will depart in order to serve a call and/or code transmitted to the call controller 3, and/or the traffic information can indicate at least one movement description from an arrival landing to a destination landing, which arrival landing an elevator car 1, 1' will move to in order to serve a call and/or code transmitted to the call controller 3. In addition, the traffic information can indicate the departure time from a departure landing at which an elevator car 1, 1' will serve a call and/or code transmitted to the call controller 3 and/or the difference time from a departure time from a departure landing after which an elevator car 1, 1' will serve a call and/or code transmitted to the call controller 3, and/or the arrival time on an arrival landing at which an elevator car 1, 1' will serve a call and/or code transmitted to the call controller 3 and/or the difference time from an arrival time on an arrival landing after which an elevator car 1, 1' will serve a call and/or code transmitted to the call controller 3. The call input via keys and the contactless call input can be combined with one another. The passenger can amend and/or delete the destination call, which is produced by reading the computer-readable data memory, on the input apparatus 41 of the call input apparatus 4. The input apparatus 41 and the output apparatus 40 may also be in the form of at least one touch screen.

Figure 7:
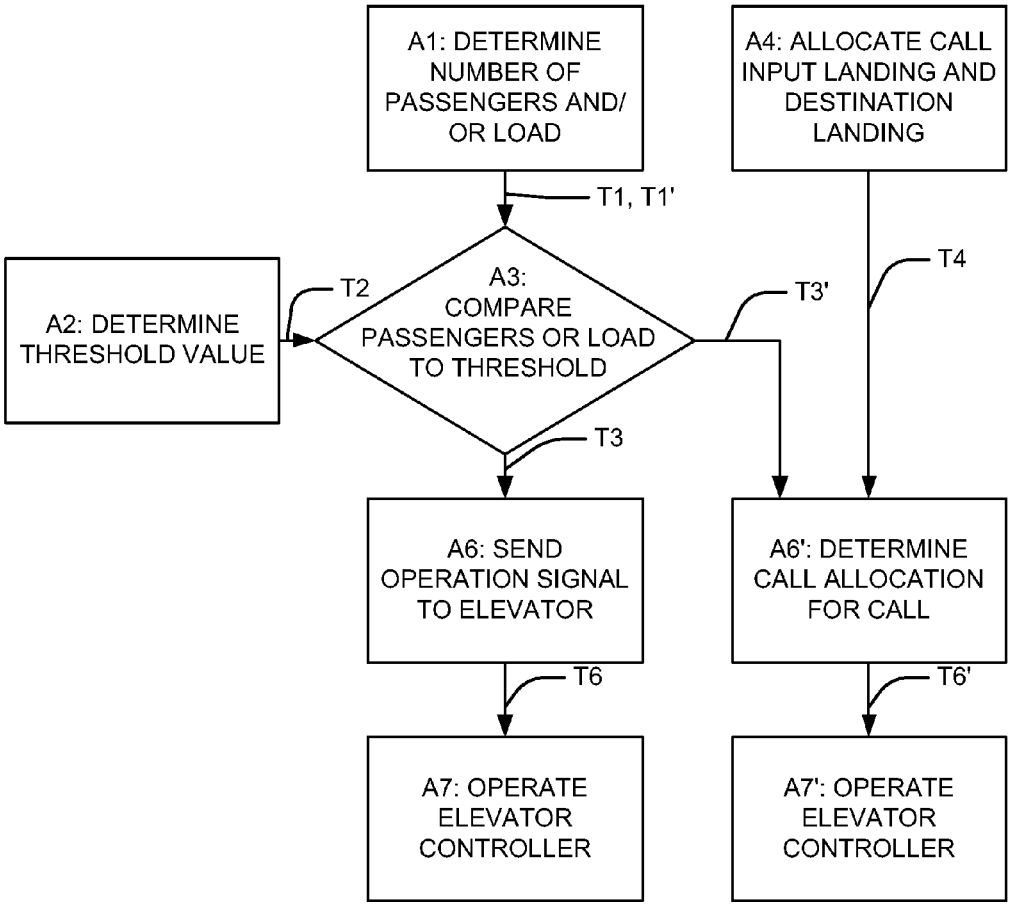
FIG. 7 shows a flowchart of a first exemplary embodiment of method steps of the method for operation of the elevator installation shown in FIG. 1.
Figure 8:
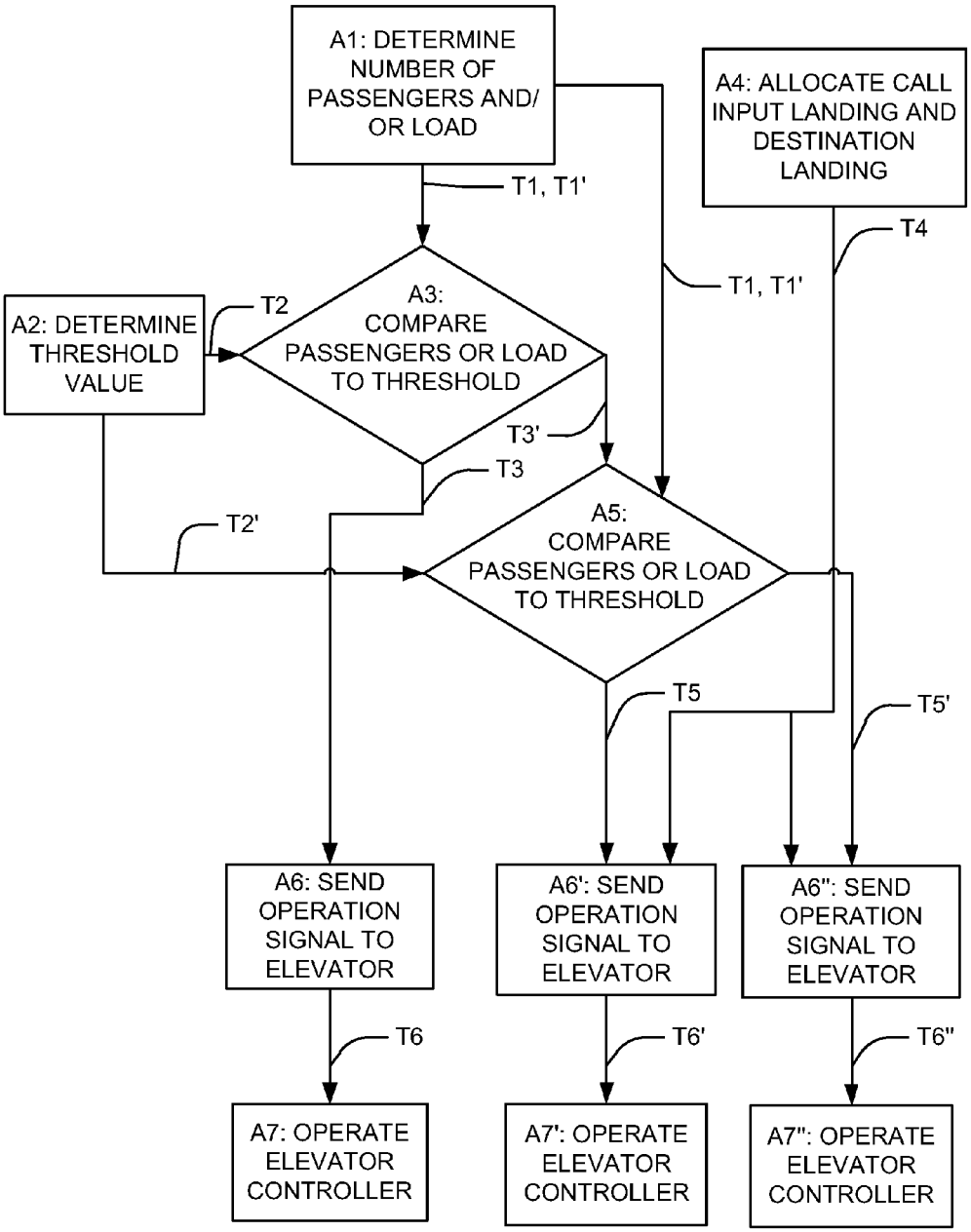
FIG. 8 shows a flowchart of a second exemplary embodiment of method steps of the method for operation of the elevator installation shown in FIG. 1.

FIGS. 7 and 8 show flowcharts of two exemplary embodiments of the method for operation of an elevator installation 100. The individual method steps will be described in more detail in the following text:

In a method step A1, a current number of passengers T1 and/or useful load T1' of the elevator installation 100 is determined for at least one sensor signal detected by a sensor 5. For this purpose, the sensor transmits the sensor signal via the signal bus 31', 31", 31'" to the call controller 3. A computer program product in the call controller 3 reads the sensor signal into at least one counting register. The counting register is area-specific, for example for a specific landing S1 to S9 and/or for a specific elevator car 1, 1' of an elevator 10, 10', 10". Various counting registers can be added and/or subtracted, such that a counting register for the elevator installation 100 can be formed from the counting registers for the landings S1 to S9 and elevator cars 1, 1'. A current number of passengers T1 and/or useful load T1' is maintained in the counting register. Sensor signals are counted for this purpose. As shown in FIGS. 2 and 3, a light sensor 51 detects a passenger entering and leaving an elevator car 1, 1' of the elevator 10, and ultrasound sensors 53 on the landings S1 to S9 detect movements of a passenger in the area in front of the elevator doors of the elevator 10. If a passenger now enters the elevator car 1, 1' of the elevator 10 on the landing S2, and the elevator car 1, 1' of the elevator 10 leaves the landing S5 again, then the counting register on the landing S2 decrements a counter, the counting register of the landing S5 increments a counter and, during the movement from the landing S2 to the landing S5, the counting register for the elevator car 1, 1' of the elevator 10 has incremented a counter. The current number of passengers T1 and/or useful load T1' can be stored in at least one computer-readable data memory in the call controller 3 and can be called up from there. The current number of passengers T1 and/or useful load T1' can be stored, provided with at least one time marking. A stored current number of passengers T1 and/or useful load T1' can be identified by means of the time marking. Optionally, there is no need to repeatedly determine the current number of passengers T1 and/or useful load T1' when the elevator installation 100 traffic recurs at specific clock times and, instead of this, a stored current number of passengers T1 and/or useful load T1' can be loaded from the computer-readable data memory, whose time marking corresponds to the current clock time. It is also possible to access stored current numbers of passengers T1 and/or the useful load T1' and to test their validity at regular or irregular intervals by comparison with newly determined current numbers of passengers T1 and/or the useful load T1'. For example, at any given clock time, a current number of passengers T1 and/or useful load T1' is determined again, and is compared with a stored current number of passengers T1 and/or useful load T1' that has been provided with a time marking corresponding to the clock time. It is also possible to estimate a current number of passengers T1 and/or useful load T1' using the transmitted sensor signal. By way of example, if a difference between the newly determined current number of passengers T1 and/or useful load T1' and the stored current number of passengers T1 and/or useful load T1' exceeds at least one tolerance range of 10%, the stored current number of passengers T1 and/or useful load T1' is replaced by the newly determined current number of passengers T1 and/or useful load T1'.

At least one freely selectable threshold value T2, T2' is determined in a method step A2. The threshold value T2, T2' is specific to the elevator installation, for example by being determined during planning and/or commission of the elevator installation 100 and, for example, being stored in at least one computer-readable data memory in the call controller 3. The threshold value T2, T2' can be loaded by the computer program means from the computer-readable data memory in the call controller 3. The threshold value T2, T2' takes account of at least one parameter of a capacity which is specific to the elevator installation, such as a size of the building of the elevator installation 100, a number of elevators 10, 10', 10" in the elevator installation 100, a speed of travel of the elevators 10, 10', 10" of the elevator installation 100, a size of the elevator cars 1, 1' of the elevators 10, 10', 10" of the elevator installation 100, an opening and closing speed of the elevator doors of the elevators 10, 10', 10" of the elevator installation 100, a power consumption of the elevators 10, 10', 10" of the elevator installation 100, etc. The threshold value T2, T2' is specific, that is to say it can be set freely for each elevator 10, 10', 10" and/or for each elevator car 1, 1'. With knowledge of the present disclosure, a person skilled in the art may take account of further parameters such as a width of the elevator doors of the elevators 10, 10', 10" of the elevator installation 100, a height of the elevator doors of the elevators 10, 10', 10" of the elevator installation 100, a landing stopping accuracy of the elevator cars 1, 1' of the elevators 10, 10', 10" of the elevator installation 100, equipment such as panoramic view, type of materials used, etc., for the elevator cars 1, 1' of the elevators 10, 10', 10" of the elevator installation 100, etc.

A traffic-technical threshold value T2 denotes an upper load-level limit for the elevator installation 100. If the traffic-technical threshold value T2 is overshot, the elevator installation is in the busy-period mode. The traffic-technical threshold value T2 is less than the capacity, which is specific to the elevator installation, by a factor of five, preferably three and preferably two. In the busy-period mode, an individual request by a passenger to travel can be considered only to a limited extent when determining the best call allocation. As soon as and as long as the traffic-technical threshold value T2 is overshot, at least one elevator 10, 10', 10" in the elevator installation 100 is allocated to the busy-period mode. The other elevators 10, 10', 10" in the elevator installation 100 remain in the normal operating mode. By way of example, in the busy-period mode, the call input landing of the passenger and the departure landing of the allocated elevator car 1, 1' as well as the desired destination landing of the passenger and the arrival landing of the elevator car 1, 1' may differ. In this case, the passenger must return by the staircase and/or escalator when a landing difference occurs. The traffic-technical threshold value T2 therefore indicates the maximum number of passengers, for which traffic load the capacity which is specific for the elevator installation is adequate to take account of an individual request by a passenger to travel during the determination of the best call allocation. Below the traffic-technical threshold value T2, the elevator installation 100 is operated in a normal operating mode and/or secondary operating mode. In the normal operating mode, the individual request by a passenger to travel is taken into account when determining the best call allocation.

An energy-technical threshold value T2' denotes a lower load-level limit for the elevator installation 100. The energy-technical threshold value T2' indicates a minimum number of passengers and/or useful load from which an individual request by a passenger to travel is still considered, but best call allocation is no longer possible. The energy-technical threshold value T2' is less than the capacity which is specific to the elevator installation by a factor of 20, possibly 10, and possibly 8. With such a small number of passengers and/or such a low useful load, the standby consumption of the elevator installation 100 is disproportionately high, for which reason at least one elevator car 1, 1' is temporarily stopped. The elevator installation 100 is then operated in a secondary operating mode, and the remaining elevator cars 1, 1' can no longer satisfy the conditions for best call allocation.

In a method step A3, A5, the call controller 3 checks whether the current number of passengers T1 and/or useful load T1' of the elevator installation 100 is greater than at least one freely selectable threshold value T2, T2'. If the current number of passengers T1 and/or useful load T1' is greater than a threshold value T2, T2', then the computer program means sets at least one traffic-technical overshoot status T3. If the current number of passengers T1 and/or the useful load T1' is less than or equal to a traffic-technical threshold value T2, then the computer program means sets at least one traffic-technical compliance status T3'. If the current number of passengers T1 and/or the useful load T1' is greater than an energy-technical threshold value T2', then the computer program means sets at least one energy-technical compliance status T5. If the current number of passengers T1 and/or the useful load T1' is less than or equal to an energy-technical threshold value T2', then the computer program means sets at least one energy-technical undershoot status T5'. The two method steps A3, A5 can be carried out at the same time, or offset in time.

In a method step A4, a call input landing and a desired destination landing are allocated to a call T4. The call input landing is the landing S1 to S9 on which the call input apparatus 4 is arranged in the building. The destination landing is the destination landing desired by the passenger. The pairing consisting of the call input landing and the destination landing desired by the passenger is stored for each call in the computer-readable data memory in the call controller 3, and can be called up from there.

In a method step A6, the call controller 3 transmits at least one main operation signal T6 to at least one specific elevator 10, 10', 10" for a traffic-technical overshoot status T3 that has been set. In the main operating mode, the computer program means produces at least one main operation signal T6 for a specific elevator 10, 10', 10". The specific elevator 10, 10', 10" is that elevator in the elevator installation 100 for which a traffic-technical threshold value T2 has been overshot.

In a method step A6', the call controller 3 determines at least one best call allocation for at least one call T4 and a set traffic-technical compliance status T3' and/or an energy-technical compliance status T5 in the normal operating mode. In the normal operating mode, the computer program means produces at least one normal operation signal T6'.

In a method step A6", the call controller 3 transmits at least one secondary operation signal T6" T6 to at least one elevator 10, 10', 10" for at least one call T4 and a set traffic-technical compliance status T3' and an energy-technical undershoot status T5' in the secondary operating mode. In the secondary operating mode, the computer program means produces at least one secondary operation signal T6".

Figure 9:
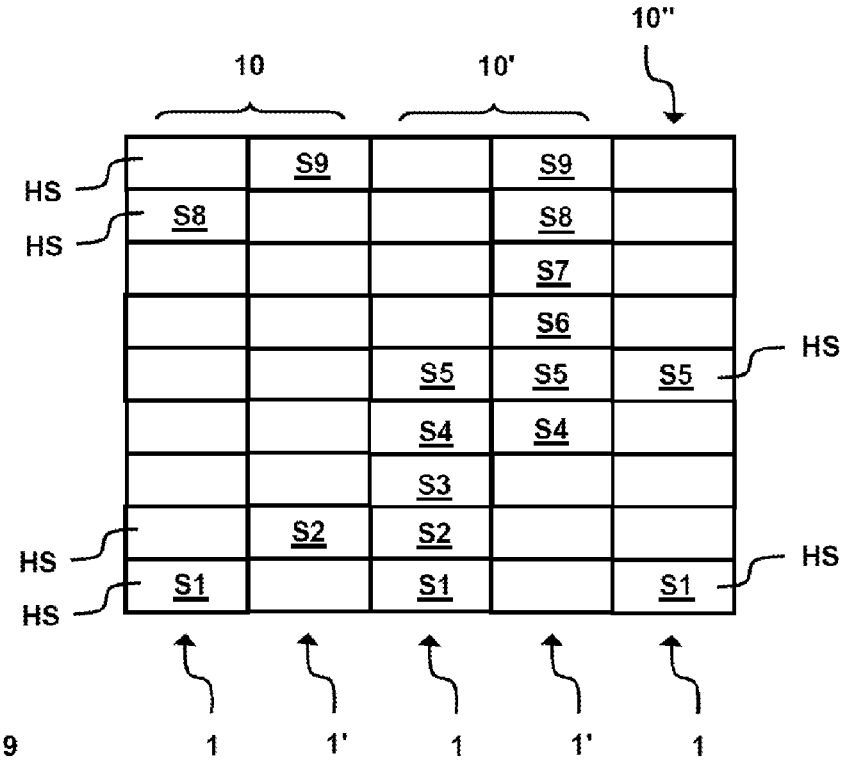
FIG. 9 shows a tabular illustration of a first exemplary embodiment of destination landings of an elevator installation which is operated in a busy-period mode according to the method shown in FIG. 7 or 8.

In a method step A7, the elevator controller 2, 2', 2" for a specific elevator 10, 10', 10" is operated by the call controller 3 with the main operation signal T6 such that the elevator car 1, 1' of the operated elevator controller 2, 2', 2" moves to only two predefined main operation landings HS in at least one main operating mode. FIG. 9 shows a tabular illustration of one exemplary embodiment relating to this. In the main operating mode of the elevator installation 100, the lower elevator car 1 of the elevator 10 moves backward and forward between the landings S1 and S8 as the main operation landings HS, and the upper elevator car 1' of the elevator 10 moves backward and forward between the landings S2 and S9 as the main operation landings HS. Furthermore, the elevator car 1 of the elevator 10" moves backward and forward between the landings S1 and S5 as main operation landings HS. The two elevators 10 and 10" are therefore allocated to the busy-period mode, while the elevator 10 is not allocated to the main operating mode. In the main operating mode, the elevators 10, 10" transport passengers to the landings S1, S2, S5, S8 and S9 as main operation landings HS, while the lower elevator car 1 of the elevator S10' serves the landings S1 to S4, and the upper elevator car 1' of the elevator S10' serves the landings S4 to S9. The elevators 10 and 10" now take account of a call T4 to convey a passenger between main operation landings HS, only to a limited extent.

Figure 10:
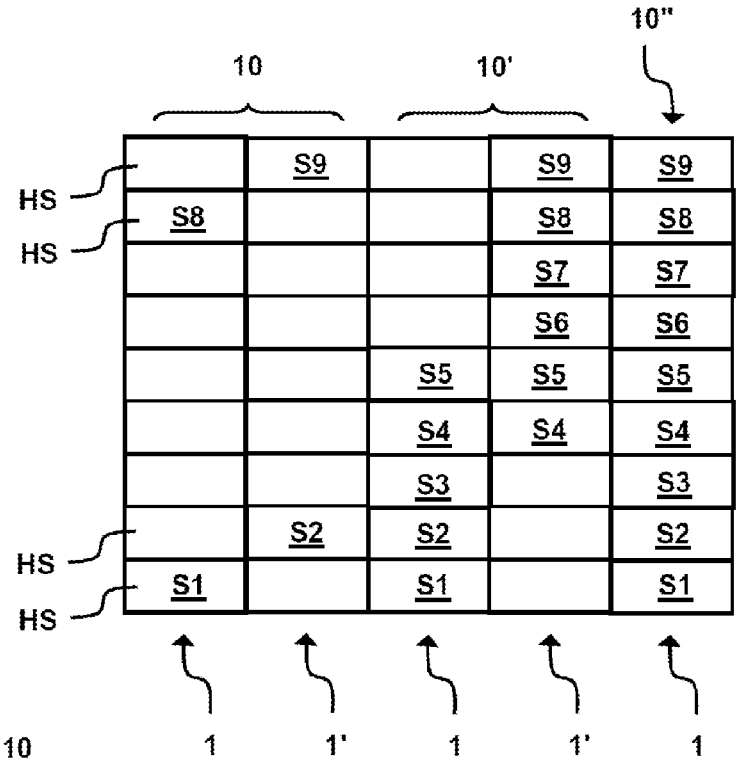
FIG. 10 shows a tabular illustration of a second exemplary embodiment of destination landings of an elevator installation which is operated in a normal operating mode according to the method shown in FIG. 8.

In a method step A7', the elevator controller 2, 2', 2" is operated by the call controller 3 with the normal operation signal T6' such that the elevator car 1, 1' of the operated elevator controller 2, 2', 2" moves to only two predefined main operation landings HS, and at least one further landing S1 to S9, in the normal operating mode. FIG. 10 shows a tabular illustration of one exemplary embodiment relating to this. In the normal operating mode of the elevator installation 100, the elevator car 1 of the elevator 10" no longer moves to only the landings S1 and S5 as in the main operating mode as shown in FIG. 9, but now moves to all the landings S1 to S9. In the busy-period mode, the elevator 10 together with its elevator cars 1, 1' continues to move to only the landings S1, S2, S8 and S9 as main operation landings HS.

Figure 11:
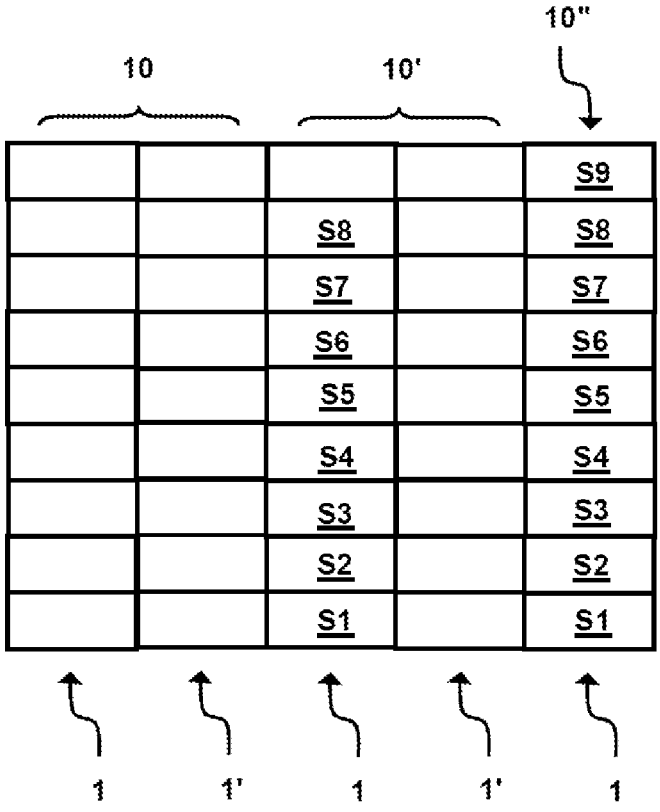
FIG. 11 shows a tabular illustration of a third exemplary embodiment of destination landings of an elevator installation which is operated in a secondary operating mode according to the method shown in FIG. 7 or 8.

In a method step A7", the elevator controller 2, 2', 2" is operated by the call controller 3 with the secondary operation signal T6", such that the elevator car 1, 1' of the elevator controller 2, 2', 2" which is operated in the secondary operating mode takes account of at least one call T4 to move to the landings S1 to S9, in at least one secondary operating mode. FIG. 11 shows a tabular illustration of one exemplary embodiment relating to this. In the secondary operating mode of the elevator installation 100, the elevator cars 1, 1' of the elevator 10 and the elevator car 1' of the elevator 10' are stopped, while the elevator car 1 of the elevator 10' serves the landings S1 to S8, and the elevator car 1 of the elevator 10" serves the landings S1 to S9.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

The invention claimed is:

1. An elevator installation operation method, comprising:

moving an elevator car of an elevator installation to a destination landing based on a destination call for a user while the elevator installation is in a first mode of operation;

changing the elevator installation to a second mode of operation;

detecting at least one passenger information item in the elevator car while the elevator car is at a first main operation landing;

determining that a given amount of time has passed since the detecting the at least one passenger information item; and as a result of the determining, moving the elevator car to a second main operation landing.

2. The elevator installation operation method of claim 1, further comprising transmitting at least one traffic signal to at least one apparatus.

3. The elevator installation operation method of claim 1, the detecting the at least one passenger information item in the elevator car being performed using a sensor, the method further comprising transmitting a sensor signal from the sensor to a call controller of the elevator installation.

4. The elevator installation operation method of claim 1, further comprising sending a call controller a number of passengers associated with a current time.

5. The elevator installation operation method of claim 1, further comprising sending a call controller a useful load associated with a current time.

6. The elevator installation operation method of claim 1, the elevator car being positioned with open doors while at the first main operation landing.

7. The elevator installation operation method of claim 1, the detecting the at least one passenger information item in the elevator car being performed as a result of a determination that a current number of passengers exceeds at least one traffic threshold.

8. The elevator installation operation method of claim 1, the detecting the at least one passenger information item in the elevator car being performed as a result of a determination that a current useful load exceeds at least one threshold.

9. The elevator installation operation method of claim 1, the method further comprising stopping the elevator car as a result of determining that a current number of passengers is less than or equal to at least one threshold.

10. The elevator installation operation method of claim 1, the method further comprising stopping the elevator car as a result of determining that a current useful load is less than or equal to at least one threshold.

11. The elevator installation operation method of claim 1, the detecting the at least one passenger information item in the elevator car being performed as a result of a determination that a current time is within a predetermined operating time.

12. The elevator installation operation method of claim 1, the detecting the at least one passenger information item in the elevator car being performed in response to a busy-period input for the elevator installation.

13. The elevator installation operation method of claim 1, further comprising changing the elevator installation from the second mode of operation to the first mode of operation in response to receiving a code from a passenger.

14. The elevator installation operation method of claim 1, the elevator car being one of a plurality of elevator cars in the elevator installation.

15. An elevator installation operation method, comprising:

operating, in a first operation mode, an elevator car according to one or more destination calls;

operating, in a second operation mode, the elevator car as a shuttle elevator for two main operation landings; and moving the elevator car, while in the second operation mode, between the two main operation landings as a result of determining that a given amount of time has passed since a passenger was detected in the elevator car.

16. An elevator installation, comprising:

an elevator car disposed in a shaft;

a sensor; and a control unit coupled to the sensor, the control unit being programmed to, move an elevator car of an elevator installation to a destination landing based on a destination call for a user while the elevator installation is in a first mode of operation, change the elevator installation to a second mode of operation, detect at least one passenger information item in the elevator car while the elevator car is at a first main operation landing, determine that a given amount of time has passed since the detecting the at least one passenger information item, and as a result of the determining, move the elevator car to a second main operation landing.

17. The elevator installation of claim 16, the elevator car being a double-deck car.

18. The elevator installation of claim 16, the sensor comprising an RFID-tag reader.

19. One or more computer-readable storage media having encoded thereon instructions that, when executed by a controller, cause the controller to perform a method, the method comprising:

moving an elevator car of an elevator installation to a destination landing based on a destination call for a user while the elevator installation is in a first mode of operation;

changing the elevator installation to a second mode of operation;

detecting at least one passenger information item in the elevator car while the elevator car is at a first main operation landing;

determining that a given amount of time has passed since the detecting the at least one passenger information item; and as a result of the determining, moving the elevator car to a second main operation landing.

20. An elevator controller comprising:

a processor; and one or more computer-readable storage media having encoded thereon instructions that, when executed by the processor, cause the processor to, operate, in a first operation mode, an elevator car according to one or more destination calls, operate, in a second operation mode, the elevator car as a shuttle elevator for two main operation landings, and move the elevator car, while in the second operation mode, between the two main operation landings as a result of determining that a given amount of time has passed since a passenger was detected in the elevator car.

* * * * *